US006602058B1

(12) United States Patent
Stewart

(10) Patent No.: US 6,602,058 B1
(45) **Date of Patent: *Aug. 5, 2003**

(54) VENTED BACKPLATE IMPELLER WATER HEATER BLOWER AND METHOD OF MIXING DILUTION AIR

(75) Inventor: Dale D. Stewart, Aurora, MO (US)

(73) Assignee: Fasco Industries, Inc., Cassville, MO (US)

( * ) Notice: Subject to any disclaimer, the term of this patent is extended or adjusted under 35 U.S.C. 154(b) by 80 days.

This patent is subject to a terminal disclaimer.

(21) Appl. No.: 09/951,193

(22) Filed: Sep. 11, 2001

Related U.S. Application Data

(60) Provisional application No. 60/232,005, filed on Sep. 12, 2000.

(51) Int. Cl.[7] ..... F04B 17/00; F04B 19/24

(52) U.S. Cl. ..... 417/366; 417/53

(58) Field of Search ..... 417/366, 53, 372; 122/4 R

(56) References Cited

U.S. PATENT DOCUMENTS

| | | | |
|---|---|---|---|
| 2,188,741 | A | 1/1940 | Roberts |
| 3,777,975 | A | 12/1973 | Kofink |
| 4,225,292 | A | 9/1980 | Hallerback et al. |
| 4,475,868 | A | 10/1984 | Renger |
| 4,799,855 | A | 1/1989 | Milocco et al. |
| 5,277,232 | A | 1/1994 | Borsheim |
| 5,352,099 | A | 10/1994 | Anstine et al. |
| 5,375,651 | A | 12/1994 | Colwell |
| 5,385,444 | A | 1/1995 | Kobayashi et al. |
| 6,231,311 | B1 | 5/2001 | Gatley et al. |

*Primary Examiner*—Teresa Walberg
*Assistant Examiner*—Vinod D. Patel
(74) *Attorney, Agent, or Firm*—Andrus Sceales Starke & Sawall, LLP

(57) ABSTRACT

A dilution air blower that has a reverse-mounted impeller contained within a combined blower housing and impeller housing. The impeller includes a vented backplate that is positioned to face a base opening of the blower housing that receives the exhaust gas from an appliance, such as a water heater. Rotation of the impeller causes the impeller to draw in a supply of dilution air which passes over the blower motor. The dilution air mixes with the exhaust gases within the mixing chamber of the impeller. The mixture of gases is discharged radially from the impeller through an exhaust outlet. The invention eliminates the need for fans dedicated to cool the blower motor while providing the required mixture of the exhaust gases and the dilution air.

15 Claims, 5 Drawing Sheets

VENTED BACKPLATE IMPELLER WATER HEATER BLOWER AND METHOD OF MIXING DILUTION AIR

CROSS REFERENCE TO RELATED APPLICATION

The present application is based on and claims priority to U.S. Provisional Application Serial No. 60/232,005 filed Sep. 12, 2000.

FIELD OF THE INVENTION

The present invention is directed to impellers, and more particularly to an impeller and method for use in water heater blowers having the optimal manufacturability, lowest cost, and most efficient design providing superior capabilities with respect to cost without sacrificing durability.

BACKGROUND OF THE INVENTION

Water heaters have been around for many years to provide hot water for both commercial and consumer usage. A water heater is commonly produced with a gas or oil fired burner. The burner produces hot gases and flames, the flame heats the base and the hot exhaust gases are channeled through the center of the water heater in a flue. The heat from the hot exhaust gases in the flue is transferred to the surrounding water, thus extracting the maximum amount of heat to increase the fuel efficiency of the process.

To maximize heat transfer from the flue to the water, the flue is typically produced with baffles and the most tortured path allowable. The maximum amount of baffles and flow reduction was limited to the flow throughput of the flue to prevent harmful buildup of carbon monoxide within the room because of the incomplete exhaust of spent gases. The limited amount of baffles in a regular water heater caused several undesirable side effects, the most important was a maximal overall operating efficiency limited to about 58%.

The low efficiency was caused by gases exiting the water heater at higher than desired temperatures because of the required throughput of the flue. This created large standby losses when the heated water was not being used because the heat from the water transferred back out through the flue due to drafts, thereby causing increased fuel usage to maintain water temperature in the standby mode.

The industry addressed this problem by adding a blower to the water heater. A blower allowed the most tortured path possible within the flue, therefore allowing a transfer of a greater amount of heat from the flue gases to the water. The blower would turn on only when the burner was on, thus literally sucking the spent gases from the flue. Without the aid of the blower, the flow through the flue is so reduced as to cause a potential backup of spent exhaust gases at the burner.

With the use of the blower, the overall efficiency of the water heater increased to about 68%. The increase in efficiency is mainly achieved through the reduced heat losses in the standby mode and the more efficient transfer of heat during the heating mode. The decrease in losses during the standby mode was achieved because the tortured path resulted in little flow through the flue without the presence of extremely hot exhaust gases and the blower motor running. With reduced airflow through the flue in the standby mode, heat transfer losses were effectively reduced.

An additional benefit of the use of a blower on a water heater was that the temperatures of the exhaust gases exiting the flue were reduced because of more efficient heat scrubbing. In naturally aspirated water heaters, the exhaust gases contained in the flue, which exited the water heater, were still extremely hot. The extreme temperature of the flue gas required the use of steel exhaust tubing that needed to be vented to the outside of the structure in a nearly vertical manner for safety reasons. The use of the blower reduced the temperatures of the spent exhaust gases to the point that a wider selection of materials was available for exhaust piping. Specifically, the use of a blower allowed for the safe use of PVC piping and the horizontal venting through the nearest wall to vent the exhaust gases to the outside atmosphere.

However, the use of a blower with a water heater presented several engineering challenges. The exhaust gases in the flue, while much lower in temperature than normally aspirated water heaters, was still above the ideal temperature for direct venting through a PVC pipe. The reduced exhaust gas temperatures desired are achieved through the mixing of the hot exhaust gases with that of dilution air at ambient temperature. The complexity and expense of the blower assisted water heater was introduced when the exhaust gases were mixed with the dilution air.

The prior art solution to adding dilution air to exhaust gases was an intricate process and an intricate plumbing arrangement that increased manufacturing cost and increased the number of potential failure sources through the myriad of connections. The prior art solution involved the use of a T-connection attached to the flue with dilution air being drawn through one side of the T-connection and the blower assembly attached on the opposing side. The whole blower assembly required multiple tubes, connections and pieces that needed to be heat resistant to direct the exhaust gases and then an intricate patchwork of tubing connecting to the blower before the final gases exited from the assembly.

The blower must be both powerful, long lasting and preferably maintenance free for use in the water heater. When blowers operate, they generate heat within the blower motor that must be removed to prevent premature failure. Conventional blower motors requires fans to cool themselves to prevent overheating. These fans, however, create extra drag upon the motor and bearings causing additional requirements of power due to parasitic losses and additional rotational mass of the motor fan. The fans also add additional parts and complexity to the blower manufacturing, therefore raising the initial cost of the blower and increasing maintenance costs of the system over its lifetime.

The present invention solves many of the problems associated with the plumbing and mixing of the hot exhaust gases with dilution air. Additionally the instant invention reduces production costs, maintenance and increases durability of the water heater blower assembly.

OBJECT OF THE INVENTION

Accordingly, it is an object of the instant invention to provide a water heater blower assembly that has superior durability.

It is another object of the instant invention to provide a water heater blower assembly that reduces the complexity involved with manufacturing.

It is yet another object of the instant invention to provide a water heater blower assembly with a synthetic material that achieves the same performance as a traditional assembly.

It is further object of the present invention to lower the cost of manufacturing a water heater blower assembly in combination with superior performance capabilities.

It is still a further object of the present invention is to provide water heater blower assembly having superior stability and reduced mass.

Another object of the present invention is to provide a water heater blower assembly with reduced material usage and less scrap.

Furthermore it is an object of the present invention to reduce the amount of secondary operations in manufacturing the water heater blower assembly.

A further object of the invention is to create a blower that fully mixes the dilution air inside the impeller only.

It is a further object to produce the primary housing of the water heater blower assembly completely from a polymeric material.

It is further object to provide a method of mixing dilution air with exhaust gases without the use of complicated ducting.

SUMMARY OF THE INVENTION

The invention achieves the above-described objectives by providing a vented backplate impeller water heater blower assembly. The instant invention is superior to the prior art water heater blower assemblies in both performance and the cost to manufacture. The instant invention uses novel designs to reduce complexity while increasing the performance of the water heater blower assembly.

The present invention uses an impeller that is mounted opposite that of conventional impeller assemblies with its inlet facing towards the blower motor. This mounting arrangement serves several novel and ingenious purposes, which makes the present invention superior to that of the prior art water heater blower assemblies.

The first benefit from reversing the impeller inlet so that it faces the motor is to provide cooling of the impeller motor. The ambient air is drawn past the motor, thereby cooling the motor as it passes. This allows for several design changes that benefit the performance of the motor.

The first change the redesign allowed is the removal of the motor cooling fan. Elimination of the cooling fan has the two major benefits of reduced complexity and reduced parts, which increases the durability and efficiency of the motor. The removal of the motor cooling fan reduces stress upon the bearings, therefore lengthening the service life of the motor. The efficiency of the motor increases by reducing the additional drag upon the motor from the removal of the motor cooling fan.

The backward mounting of the impeller in the water heater blower assembly has several other major benefits over the prior art designs. The backward mounted impeller assembly allows for cooling of the motor through dilution air. Cooling using the dilution air also allows another additional benefit. The backplate of the backward mounted impeller is then vented, drawing in hot flue gases and mixing them with the dilution air within the impeller. The impeller itself blends the dilution air and flue gases.

The vented backplate of the impeller mixes the dilution air with the flue gases, thereby allowing for a complete redesign. The redesign consists of having the water heater blower assembly mounted atop the water heater without direct connection to the flue pipe. The vented impeller backplate faces the exhaust flue with no direct contact, thus removing intricate ducting and connections of the prior art that could potentially fail. Further, the vented backplate reduces maintenance and assembly costs by reducing unnecessary connections and parts.

The novel vented backplate mixes the flue gases with the dilution air instead of the complex ducting and method required for mixing dilution air with exhaust gases of the prior art. Thus, the water heater blower impeller integrates several functions that were previously performed by several elements. The mixing of the dilution air with the hot flue gases within the impeller allows the blower motor house to be made primarily out of plastic. Thus, the output of the impeller is vented directly out the exhaust pipe to the outside of the structure effectively bypassing several other operations performed in the prior art.

The new and novel method of mixing two or more gases, such as dilution air with that of hot exhaust gases, with the use of a backwards mounted impeller has been discovered. While this method of mixing works well when applied to water heater blower apparatuses, it has many other potential applications. This method of mixing could be applied to any system or apparatus in which one would desire to mix two or more gases or fluids with the intention of controlling temperature or other mixture dependent properties of gases.

The method contemplates a backwards mounted impeller with inlet gases or fluids passing over the motor for cooling and a vented backplate for the controlled introduction of a second gas or fluid which is the limited reagent for mixing within the backwards mounted impeller. Mixing occurs within the backwards mounted impeller, where the mixture is then expelled radially outward where the blended gases or fluids are directed out of the impeller housing for their desired purpose.

These and other objects of the instant invention will be apparent from a reading of the following detailed description of the instant invention.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
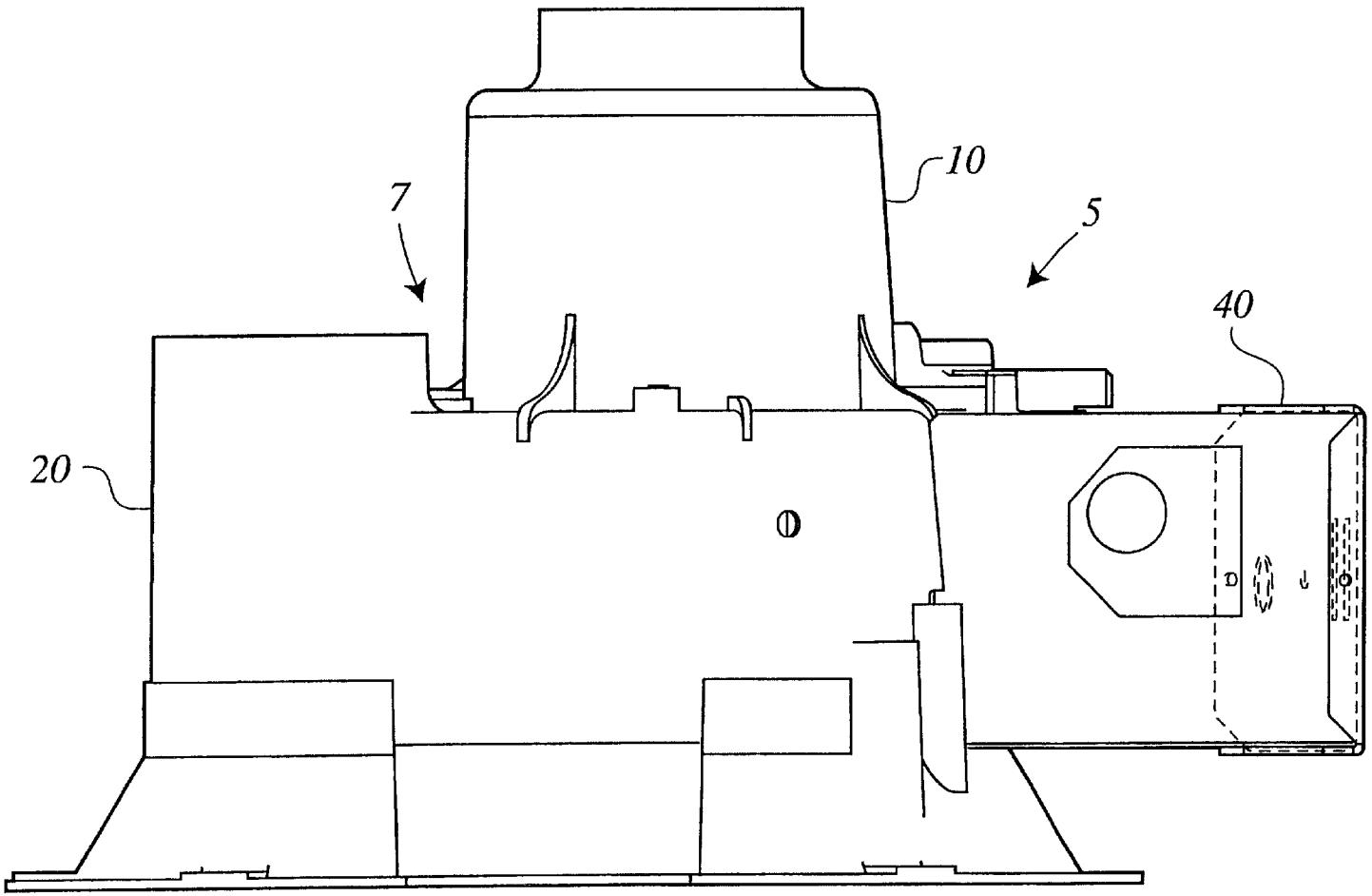
FIG. 1 illustrates a front view of the outside of a blower motor housing of the present invention.
Figure 2:
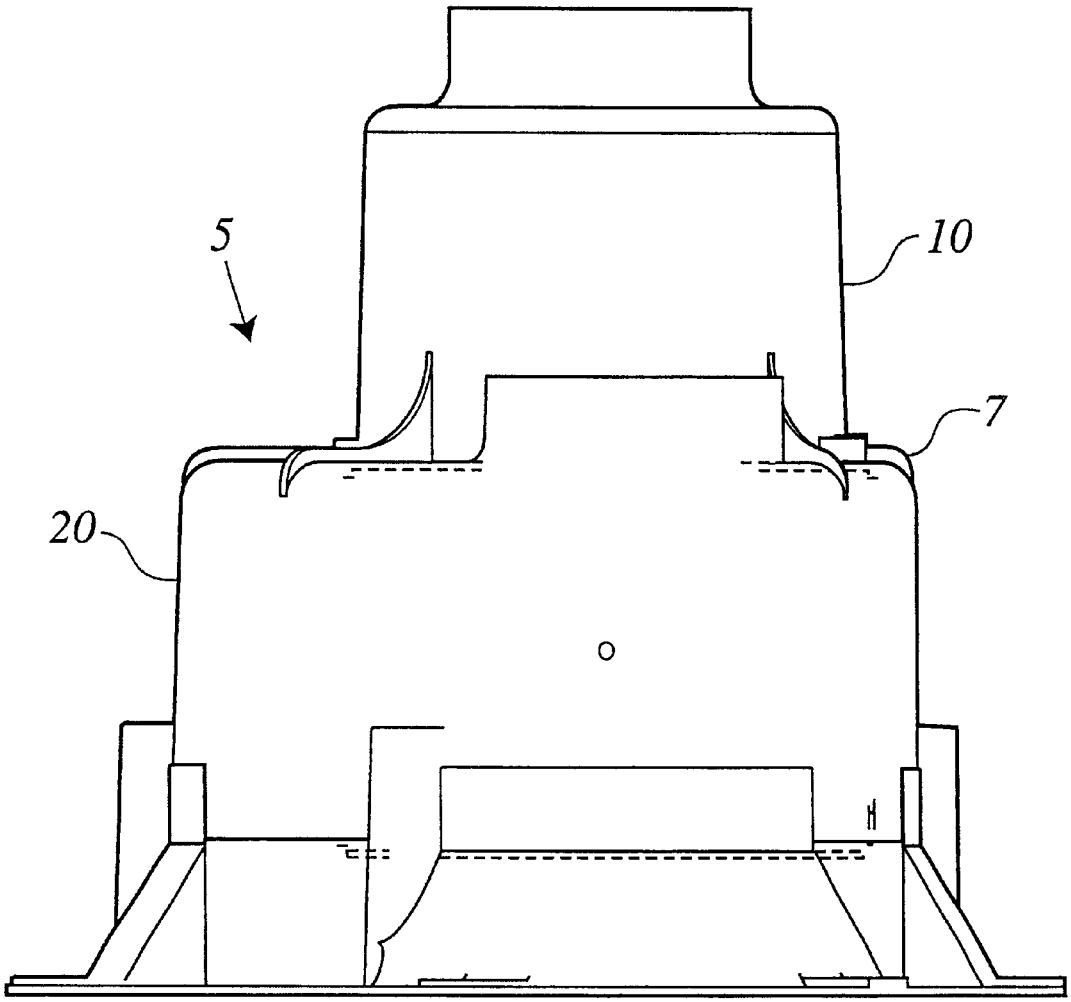
FIG. 2 illustrates a side view of the outside of the blower motor housing.

FIGS. 1 and 2 show the exterior of the blower assembly 5 of the present invention. The blower assembly 5 includes a unitary blower housing 7 including a motor housing portion 10 mounted atop an impeller housing portion 20. An optional control assembly housing 40 is shown mounted to impeller housing 20.

The housing 7 for the blower assembly 5, including both the motor housing portion 10 and the impeller housing portion 20, is preferably made of a polymer material which is injection molded using conventional processes, although any relatively stiff material can be used, such as stamped metal.

Figure 3:
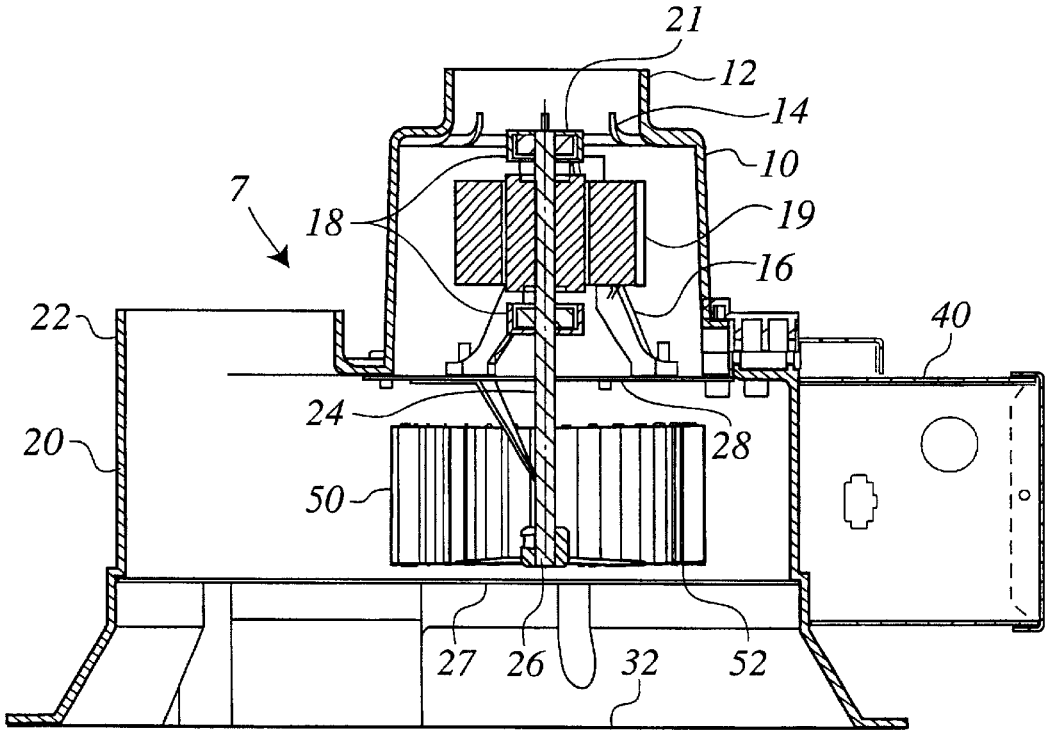
FIG. 3 illustrates a section view of the blower motor housing and vented backplate assembly mounted therein.

FIG. 3 shows a side cutaway view of the blower housing 7 of the present invention. The inlet motor housing portion 10 forms an inlet 12 to allow entry of dilution air over a motor 19 for the purposes of cooling the motor 19 during operation and providing dilution air to a backwards mounted vented impeller 50. The dilution air-cooled motor 19 is mounted within inlet housing portion 10 upon support legs 16.

A motor output shaft 24 is supported by a pair of bearings 18 that provide stability for the rotating output shaft 24. Bearings 18 are supported by an upper bearing strap 21 and the lower support legs 16. As illustrated, the motor output shaft 24 is rotatably mounted centrally within the air-cooled motor 19.

The motor output shaft 24 having an impeller end 26 extends into the impeller housing portion 20, allowing the mounting of backwards mounted vented impeller 50 onto impeller end 26. The motor output shaft 24 passes through an opening 27 formed in the motor mounting plate 28, which allows dilution air to enter an inlet opening of backward mounted vented impeller 50.

The impeller housing portion 20 forms an exhaust port 22 that allows the mounting of an exhaust pipe made of PVC or other material suitable for exhausting diluted exhaust gases. The impeller housing portion 20 is designed to channel the output of the backward mounted vented impeller 50 away from the water heater assembly.

Figure 4:
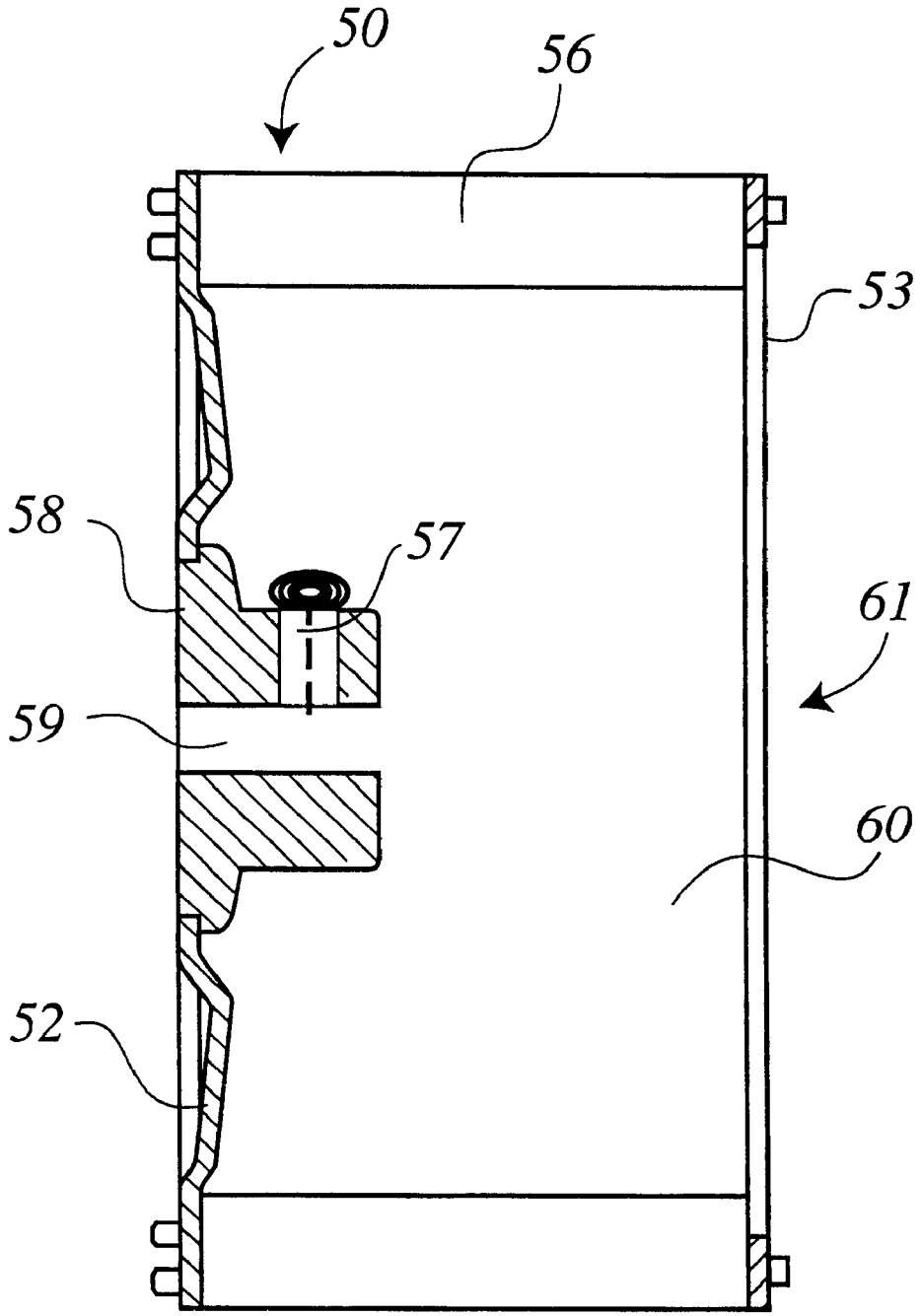
FIG. 4 is top view of the impeller.
Figure 5:
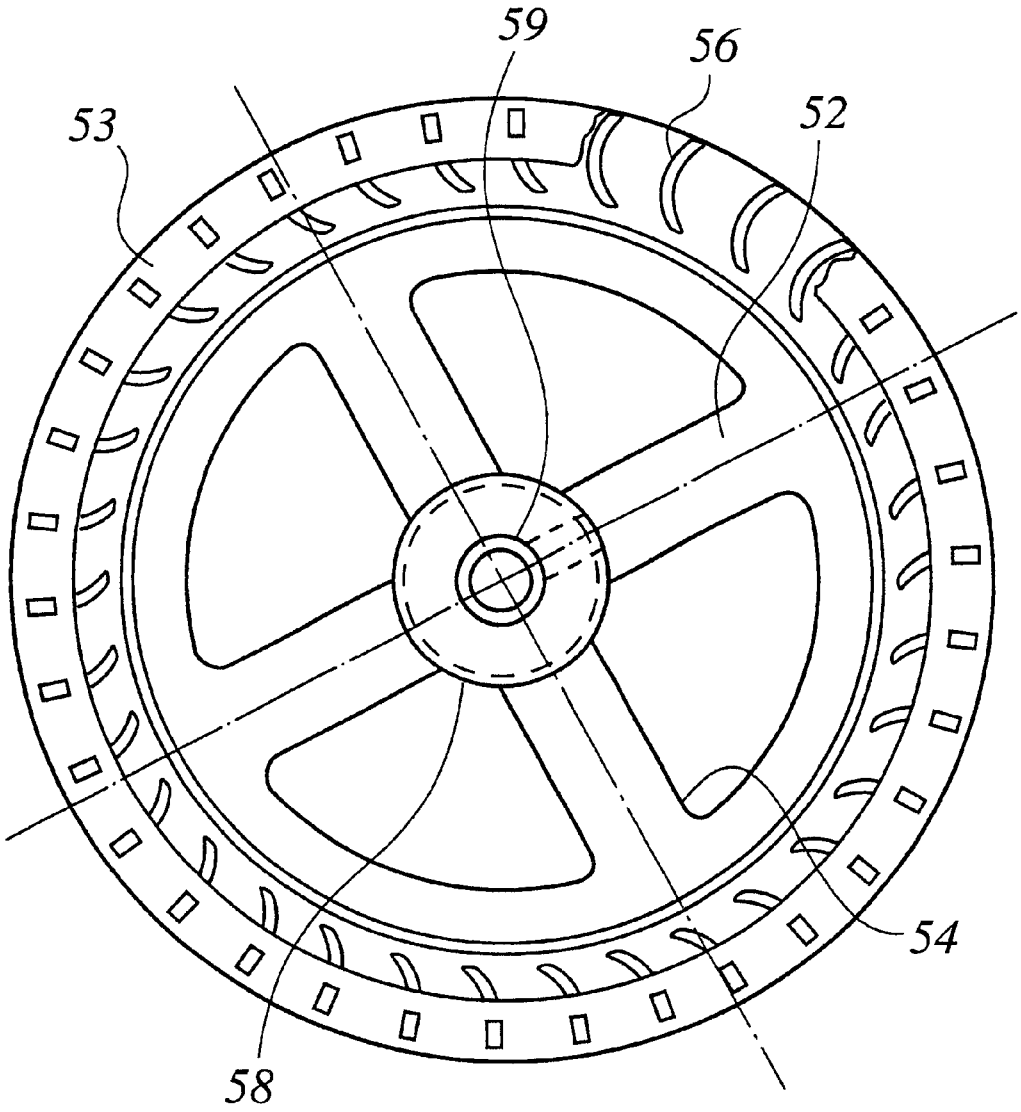
FIG. 5 is a bottom view of one embodiment of a vented backplate.

The impeller housing portion 20 contains the backwards mounted vented impeller 50, which is positioned to be in the direct path of hot flue gases exiting the flue. The flue gases enter the blower housing 7 through a base opening 32. The backward mounted vented impeller 50 has a backplate 52 which faces the flue. FIGS. 4 and 5 illustrate the backplate 52, which has an openings that form vents 54 which allow the blending of hot flue gases with the dilution air drawn in through inlet 12, thereby causing the exhaust air discharged from backward mounted vented impeller 50 to be of a temperature which allows for the use of PVC exhaust piping.

Referring now to FIG. 3, the impeller housing 20 is mounted directly upon the outer surface of the water heater tank opening. Within the water tank opening is a centrally positioned flue (not shown). Impeller housing portion 20 provides a base opening 32 above water heater flue, such that the backwards mounted vented impeller 50 is placed above base opening 32 thereby allowing exhaust flow of flue to be directed upon backwards mounted vented impeller 50. The water heater flue pipe terminates within the water heater body and does not directly come into contact with the impeller housing portion 20 or the backwards mounted vented impeller 50, thereby eliminating costly ducting.

FIGS. 4 and 5 display the backward mounted vented impeller 50 which blends dilution air with that of hot exhaust gases from the flue. Backwards mounted vented impeller 50 contains hub 58 which forms a base 59 that receives motor output shaft 24 to provide rotation. Optionally set screw 57 may be used to secure motor output shaft 24 within bore 59, allowing for removal and reinstallation of backwards mounted vented impeller 50 when desired.

The impeller 50 includes a central, mixing chamber 60 into which the dilution air from the inlet 12 enters through a central, inlet opening 61 in the inlet support ring 53 and the flue gases enter through the vents 54 formed in the backplate 52. Rotation of the impeller 50 causes the mixed gases to flow radially outward, due to the configuration of the impeller blades 56.

The backward mounted vented impeller 50 consists of impeller blades 56 which can be either straight, forward curved or backward curved designs. In a preferred embodiment of the invention, the backward mounted vented impeller 50 is a squirrel cage type impeller design, but any design which would allow for internal mixing is permissible. Impeller blades 56 are mounted to backplate 52 and inlet support ring 53.

FIG. 5 displays the vented backplate 52 of backward mounted vented impeller 50. The vents 54 can consist of any opening that would allow for the entry of exhaust flue gases to blend with that of the dilution air. In one preferred embodiment shown in FIG. 5, the vents 54 are triangle shaped wedges. In another preferred embodiment (not shown), the vents 54 are angular slits which are punched into the backplate 52 so that the angular slits preferably have openings which face the direction of rotation thus aiding in the mixture of the flue gases with the dilution air through a pumping action.

The blower assembly is a sealed unit that allows entrance of air only through inlet 12 into the unit. Furthermore, exit of exhaust gases is allowed only through exhaust port 22. Sealing between the blower housing and the water heater tank can be accomplished through mechanical means such as interlocking surfaces or gaskets if desired or required in the specific application. Sufficient sealing of the unit is designed to prevent harmful leaking of poisonous exhaust gases.

The method of mixing two or more gases contemplated involves a backwards mounted vented impeller 50 wherein the inlet portion of the impeller faces the motor 19 allowing a gas or fluid to pass over motor 19 for purposes of cooling. A backplate 52 which contains at least one vent 54 for allowing the introduction of a second gas or fluid is positioned over the base opening 32 through which the second gas enters. The second gas, or flue exhaust gas in the present invention, is considered the limiting reagent for mixing within the body of the backwards mounted vented impeller 50. Upon rotation of backwards mounted vented impeller 50, a large amount of inlet gas or fluid is drawn past the motor 19 entering the inlet portion of backwards mounted vented impeller 50 and a second gas or fluid of a lesser amount than that drawn in through the inlet portion is blended and mixed completely within mixing chamber 60 of the body of backwards mounted vented impeller 50. Once mixed, the gas or fluid is then discharged radially from the backwards mounted vented impeller 50 and directed by the impeller housing portion 20 out exhaust port 22.

It will be appreciated that the preferred embodiment and claims are set forth by way of illustration and do not depart from the spirit and scope of the instant invention. It is to be understood that the instant invention is by no means limited to the particular embodiments herein disclosed, but also comprises any modifications or equivalents within the scope of the claims.

Having thus described my invention, what I claim as new and desire to secure by United States patent:

I claim:

1. A dilution air blower, comprising:

a blower housing having a gas inlet for receiving a first gas, the blower housing defining a base opening, wherein the base opening is positioned to receive a second gas;

a blower motor mounted within the blower housing, the blower motor having a rotatable central motor shaft; and an impeller mounted to the motor shaft for rotation with the motor shaft, the impeller being positioned within the blower housing, the impeller including a mixing chamber defined by a backplate and an inlet opening, the backplate including a plurality of vents that allow gas to pass through the backplate and into the mixing chamber;

wherein upon rotation of the impeller, the first gas and the second gas are drawn into the mixing chamber and mixed therein.

2. The dilution air blower of claim 1 wherein the blower housing is formed from a polymer material.

3. The dilution air blower of claim 1 wherein the blower motor is aligned with the inlet opening of the blower housing such that the flow of the first gas created by the rotating impeller passes over the blower motor.

4. The dilution air blower of claim 1 wherein the number of vents formed in the impeller backplate are selected to control the mixing of the first gas and the second gas.

5. The dilution air blower of claim 1 wherein the impeller is positioned such that the backplate faces the base opening of the blower housing and the inlet opening faces the gas inlet of the blower housing, such that the first gas enters the mixing chamber through the inlet opening and the second gas enters the mixing chamber through the backplate.

6. The dilution air blower of claim 5 wherein the blower housing includes a gas outlet that receives a flow of outlet gas formed from the mixture of the first gas and the second gas.

7. The dilution air blower of claim 1 wherein the impeller includes a plurality of blades mounted between the backplate and an inlet support ring, wherein the impeller blades define the outer edge of the mixing chamber.

8. A dilution air blower for mixing an exhaust gas from a water heater with dilution air, the blower comprising:

a blower housing having a dilution air inlet open to atmosphere to receive the dilution air, the blower housing including a base opening that is positioned to receive the exhaust gas, the blower housing further including an exhaust outlet;

a blower motor positioned within the blower housing, the blower motor having a rotatable central motor shaft; and an impeller mounted to the motor shaft for rotation with the motor shaft, the impeller being rotatably positioned within the blower housing, the impeller including a mixing chamber defined by a backplate and an inlet opening, the backplate having a plurality of vents that allow the exhaust gas to pass through the backplate, the impeller being mounted to the motor shaft such that the inlet opening faces the dilution air inlet and the backplate faces the base opening of the blower housing;

wherein rotation of the impeller causes the dilution air to enter the mixing chamber through the inlet opening of the impeller and causes exhaust gas to enter the mixing chamber through the vented backplate of the impeller.

9. The dilution air blower of claim 8 wherein the blower motor is aligned with the dilution air inlet such that the flow of dilution air created by the rotating impeller flows over the blower motor.

10. The dilution air blower of claim 8 wherein the surface area of the vents formed in the backplate is selected to control the mixture of the dilution air and the exhaust gases.

11. The dilution air blower of claim 8 wherein the blower housing is formed from a polymer material.

12. The dilution air blower of claim 8 wherein the dilution air and exhaust gases are mixed within the mixing chamber and radially discharged from the impeller through the exhaust outlet.

13. A method of diluting exhaust gases from a water heater, the method comprising the steps of:

providing a dilution air blower at the exhaust discharge of the water heater, the dilution air blower comprising:

a blower housing having a gas inlet open to atmosphere for receiving dilution air, the blower housing including a base opening that is positioned to receive the exhaust gas, the blower housing further including an exhaust outlet;

a blower motor positioned within the blower housing, the blower motor having a rotatable central motor shaft;

an impeller mounted to the motor shaft and rotatably positioned within the blower housing, the impeller including a mixing chamber defined by a backplate and an inlet opening, the backplate having a plurality of vents positioned to face the base opening of the blower housing;

rotating the impeller to develop negative air pressure in the mixing chamber to draw dilution air through the inlet opening and to draw exhaust gases through the vented backplate;

mixing the exhaust gas with the dilution air in the mixing chamber of the impeller; and expelling the gas mixture from the dilution air blower via the exhaust outlet.

14. The method of claim 13 further comprising the step of positioning the blower motor in alignment with the dilution gas inlet opening of the blower housing.

15. The method of claim 13 wherein the impeller is connected to the motor shaft such that the backplate faces the base opening and the inlet opening of the impeller faces the gas inlet of the blower housing.

* * * * *